US006540228B2

(12) United States Patent
Delello

(10) Patent No.: US 6,540,228 B2
(45) Date of Patent: Apr. 1, 2003

(54) METHOD AND SYSTEM FOR GO FISH 21 CARD GAME

(76) Inventor: John Delello, 1400 Golden Cir. #302, Golden, CO (US) 80401

( * ) Notice: Subject to any disclaimer, the term of this patent is extended or adjusted under 35 U.S.C. 154(b) by 0 days.

(21) Appl. No.: 09/970,709

(22) Filed: Oct. 5, 2001

(65) Prior Publication Data

US 2002/0043762 A1 Apr. 18, 2002

Related U.S. Application Data

(60) Provisional application No. 60/237,682, filed on Oct. 5, 2000.

(51) Int. Cl.[7] ..... A63F 1/00
(52) U.S. Cl. ..... 273/274; 273/292
(58) Field of Search ..... 273/274, 292

(56) References Cited

U.S. PATENT DOCUMENTS 5,538,252 A * 7/1996 Green
5,615,888 A * 4/1997 Lofink et al.
5,690,337 A * 11/1997 Somma et al.
5,695,192 A * 12/1997 Brown

* cited by examiner

*Primary Examiner*—William M. Pierce
(74) *Attorney, Agent, or Firm*—Piper Rudnick LLP; Wilburn L. Chesser

(57) ABSTRACT

A method and system for playing a casino style card game, referred to as "Go Fish 21," in conjunction with standard rules for Blackjack, using a shoe of five or six standard decks of cards and a special set of 14 Go Fish playing cards. These 14 cards, which include standard cards valued 3–10, Jack, Queen, King, and Ace, along with 2 Jokers, are placed face down prior to play of the game. In conjunction with standard Blackjack play, prior to dealing any cards, the players optionally place a selection for play of Go Fish 21, including wager, to receive a special bonus card in the event that the participating player is dealt a "Blackjack" hand. Upon a "Blackjack" hand being dealt to a player selecting to play Go Fish 21, that player selects one of the remaining Go Fish cards. A payout is made based on the card.

20 Claims, 4 Drawing Sheets

METHOD AND SYSTEM FOR GO FISH 21 CARD GAME

This application claims priority from U.S. Provisional Application Ser. No. 60/237,682 filed Oct. 5, 2000. The entirety of that provisional application is incorporated herein by reference.

BACKGROUND OF THE INVENTION

1. Field of the Invention

This invention relates to a game, and in particular to a casino-style game played with at least one standard deck of cards and 14 special cards, the game being played in accordance with the rules of Blackjack.

2. Background of the Technology

It is known in the art to provide card games, such as Blackjack, in a casino environment or consistent with casino style rules. In these games, the gaming establishment typically seeks to attract as many participants to a game as possible to increase the money collected at the gaming table. In addition, the number of games played during a specified time, such as the number of hands per hour, is also an important metric used to evaluate the return potential for a game. That is, the more hands that are played during a unit of time, the greater the money collected by the house and the corresponding profit realized.

There is a need for card games having improved play over standard Blackjack to attract and maintain customer participation. There is a further need for such games that include features, such as additional card selection and drawing for bonus play, to maintain player interest and play after initial dealing of the hand.

SUMMARY OF THE INVENTION

The present invention relates to a method and system for playing a casino style card game, referred to as "Go Fish 21," which is played in conjunction with standard rules for Blackjack, also known as "21," using a shoe of five or six decks of cards and a set of special "Go Fish" bonus cards. The game may be played, for example, on a gaming table by players and a dealer using standard cards and special "Go Fish" bonus cards, or, for example, on a terminal, such as a computer or other electronic medium, using representations of various features of the game on a display device using a graphical user interface (GUI). The terminal can include, for example, a personal computer, minicomputer, microcomputer, or mainframe computer and a display device or coupling to a display device. The game is also playable in electronic form or in conjunction with electronic features over a network, such as the Internet or using other gaming devices, such as slot machines.

For play of Go Fish 21, in an embodiment of the present invention, a special set of 14 Go Fish playing cards or representations thereof are used. These 14 cards, which include standard cards valued 3–10, Jack, Queen, King, Ace, along with 2 Jokers, are shuffled and fanned face down prior to play of the game commencing. In conjunction with play of Blackjack, including standard rules for wagering during play (e.g., placing ante bets and wagers during the course of play), for each hand, prior to dealing any cards, Go Fish 21 provides for the optional placement of a selection, including wager, by each player to receive a special bonus card in the event that the participating player is dealt a "Blackjack" hand. Upon a "Blackjack" hand being dealt to a player selecting to play Go Fish 21, that player is prompted to select one of the remaining Go Fish cards. This selection is made, for example, by placing a lammer, other marker, or other indication, such as by electronic selection, at a location corresponding to or indicating the card to be selected. The card selected is then revealed to the player, and a payout is made based on the card. In one variation, if a Joker is revealed, a second card is selected by the player, and the bonus is increased.

Additional advantages and novel features of the invention set forth in part in the description that follows, considered in conjunction with the accompanying drawing figures, will become more apparent to those skilled in the art upon examination of the following or upon learning by practice of the invention. It is to be understood, however, that the drawings are designed solely for the purposes of illustration and not as a definition of the limits of the invention.

DETAILED DESCRIPTION

Figure 1A:
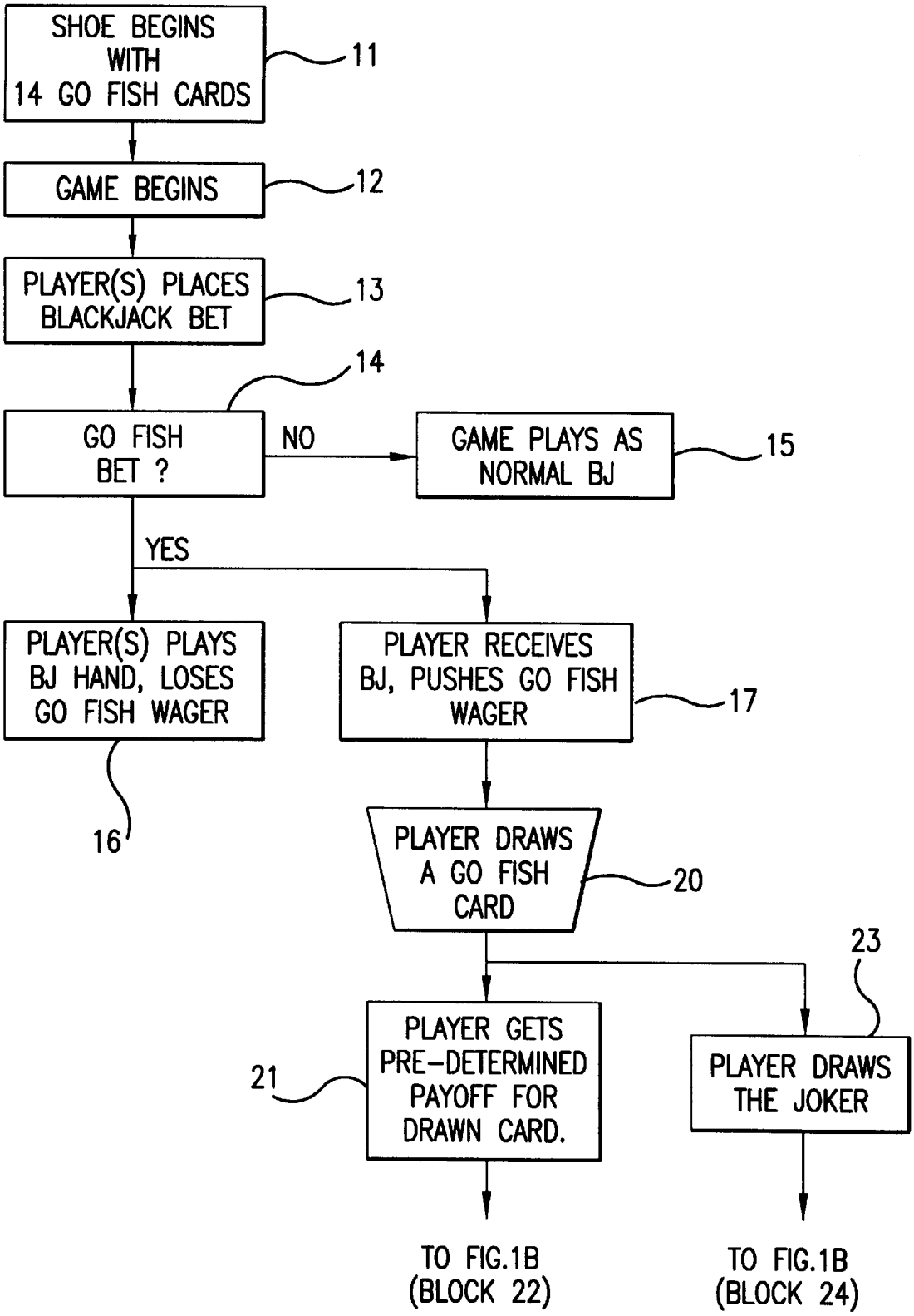
FIGS. 1A and 1B depict a flow diagram of play of a game in accordance with an embodiment of the present invention.

The game in accordance with an embodiment of the present invention includes play essentially similar to standard five or six deck Blackjack dealt from a shoe. Other numbers of decks may also be used. One variance from standard Blackjack play is that when a player obtains a "Blackjack" hand, that player has the opportunity to draw a card (such as one of fourteen from a markedly different deck of cards that are kept tightly fanned on the table) for an additional or bonus payout.

For a player to be able to "go fish" after obtaining "Blackjack," the player must place a dollar bet in the top left corner of the wager spot before the hand is dealt. It is legal for no players, one player, two, three, or any number of players to buy "fishing rights" for any or all hands. The side wager is placed on a hand to hand basis.

When and if no player(s) receive a "Blackjack" hand, the dealer "locks up" the "go fish" wager for each player as the dealer gets to that player's hand, prior to "hitting" the hand (e.g., dealing an additional card). If the "go fish" player receives a "Blackjack" hand, the side wager is kept by the player. Next, play is quickly suspended for the player to place, for example, a lammer on the particular corresponding number of the card position from which that player wishes to draw.

Placing a lammer on the number, in accordance with this embodiment of the present invention, provides the quickest, least disruptive method to "go fish." Without players reaching and touching cards, the game continues at its pace. If a player places a lammer over number "5," for example, the dealer picks the card that is positioned in the fifth position from the players'far left. Obviously, if only 10 cards remain, and the player places a lammer over position 13, the dealer must be astute enough to tell the player that there are only 10 cards remaining. The dealer then exposes the drawn card to the whole table and promptly pays the player the bonus won.

The "go fish" cards and their bonus payouts (based on an example $1 bet), in accordance with one embodiment of the present invention, are as follows:

Ace: $25

10, J, Q, K: $20

2 through 9: Double the card face value ($4 to $18)

Joker: The player selects another card and receives triple the dollar amount of the face value of the card. For example, the player picks the Joker; the player then picks an Ace; the player receives a $75 bonus. In another example, the player picks the Joker; the player then selects the "3"; the player receives an $18 bonus.

After a player uses a "go fish" card, that card is placed in a separate "dead fish pile" or otherwise discarded. Each card is only used once per shoe. Once each card is used, it is effectively out of play until the commencement of the next shoe. This provides a nearly infinite amount of playing options. For example, on the third hand, a "go fish" player receives a "Blackjack" hand, then draws a Joker and a "3." That Joker—the triple bonus multiplier card—will not be used again until the next shoe. This is what is referred to as "a tragic waste of a Joker." Conversely, if there are but six "go fish" cards remaining, and the players know that a Joker and a ten remain, it will not be surprising to see every player place the side wager and become more concerned about getting a "Blackjack" than being concerned about the ubiquitous 15 and 16 hands that are inherent to the game.

At the conclusion of each shoe, the fishing cards are washed and fanned, and the game begins again with a fresh deck of 14 "Go Fish" cards.

Play in Strange Scenarios and Infrequent Situations

If both the dealer and the "go fish" player have "Blackjack," the "Go Fish" wager is pushed, and the player proceeds to "Go Fish."

In the very unlikely possibility that the "Go Fish" player draws the last "Go Fish" card, and that card happens to be the Joker, that player receives a $500 bonus.

If two players have placed "Go Fish" wagers, and both receive "Blackjack" hands, but only one "Go Fish" card remains to be drawn, both players receive that payout. For example, a player at first base receives a "Blackjack" hand, as does a player at third base (third position at the table). The "Blackjacks" are simultaneous, although first base is first in order to draw the "Go Fish" card. The first base player then draws the "King" as the last "Go Fish" card. Both the first base player and the third base player are paid a $20 bonus for the "King."

If all 14 "Go Fish" cards are used during the shoe (highly unlikely), it is up to the house whether the "Go Fish" cards are to be re-washed and the game to continue for the remainder of that shoe. The house has the right to wait until the commencement of the shoe to wash and fan the "Go Fish" cards.

Interesting Features of the Game

1. Makes Blackjack more exciting for the players, dealers, and spectators.
2. Encourages players to stick out a bad shoe for the possibility of "going fishing." Encourages players to play on a dead table, because such tables provide more chances to "go fishing" and earn more bonus money.
3. Does not require a separate table, such that poker game variations require. Can be played on a regular Blackjack table with very slight table layout modifications. Takes up no additional space/money investment from casinos.
4. Can be played in conjunction with standard Blackjack. "Go Fish" changes no player's betting/playing strategies.
5. Is very simple to deal, teach, and play.
6. Is so simple, the game is no work to set up and monitor by the casino or gaming commissions.
7. Offers a new chance to play or not to play for the bonus on each and every new hand.
8. Is a unique, more interactive approach to Blackjack.

Example Probability Calculations for Blackjack and Go Fish 21 in Accordance With An Embodiment of the Present Invention Example Probability Calculation for Blackjack 1. Number of cards in 6 deck shoe: 6×52=312.
2. Dealer cuts 1 deck short: 312–52=260.
3. At approximately 3 cards/hand, the number of hands the dealer deals per shoe is as follows: 260/3≅87.
4. With 5 players at table, the number of player hands (with one dealer hand) is as follows: 5/6×87≅73.
5. At 2.5 cards per hand, the number of hands the dealer deals is as follows: 260/2.5=104.
6. For 5 players @ 2.5 cards per hand, the number of player hands the dealer deals is as follows: 5/6×104≅87.
7. The probability of a "Blackjack" hand is as follows:
   The probability of an ace is 1 in 13≅7.7%;
   The probability of a 10, J, Q, or K is 4 in 13≅30.8%;
   The probability of a "Blackjack" hand is therefore as follows:
   7.7%×30.7%≅2.4%.
8. For 5 players @ 2.5 cards per player, the expected number of "Blackjacks" per shoe is as follows: 87×2.4%=2.06.
9. For 5 players @ 3 cards per player, the expected number of "Blackjacks" per shoe is as follows: 73×2.4%=1.73.

Example Probability Calculation for Go Fish 21

1. The probability of receiving a Joker is as follows: 2/14≅14.2%.
2. The probability of receiving an Ace is as follows: 1/14≅7.1%.
3. The probability of receiving a Joker followed by an Ace is as follows: 2/14×1/13≅1%.
4. The probability of receiving a 10, J, Q, or K is as follows: 4/14≅28.6%.
5. The probability of receiving a Joker followed by a 10, J, Q, K is as follows: 2/14×4/13≅4.3%.
6. The probability of receiving a 3 through 9 after already receiving a Joker is as follows: 7/13≅53.8%.

References will now be made in detail to embodiments of the present invention, examples of which are illustrated in the accompanying drawings.

Figure 1B:
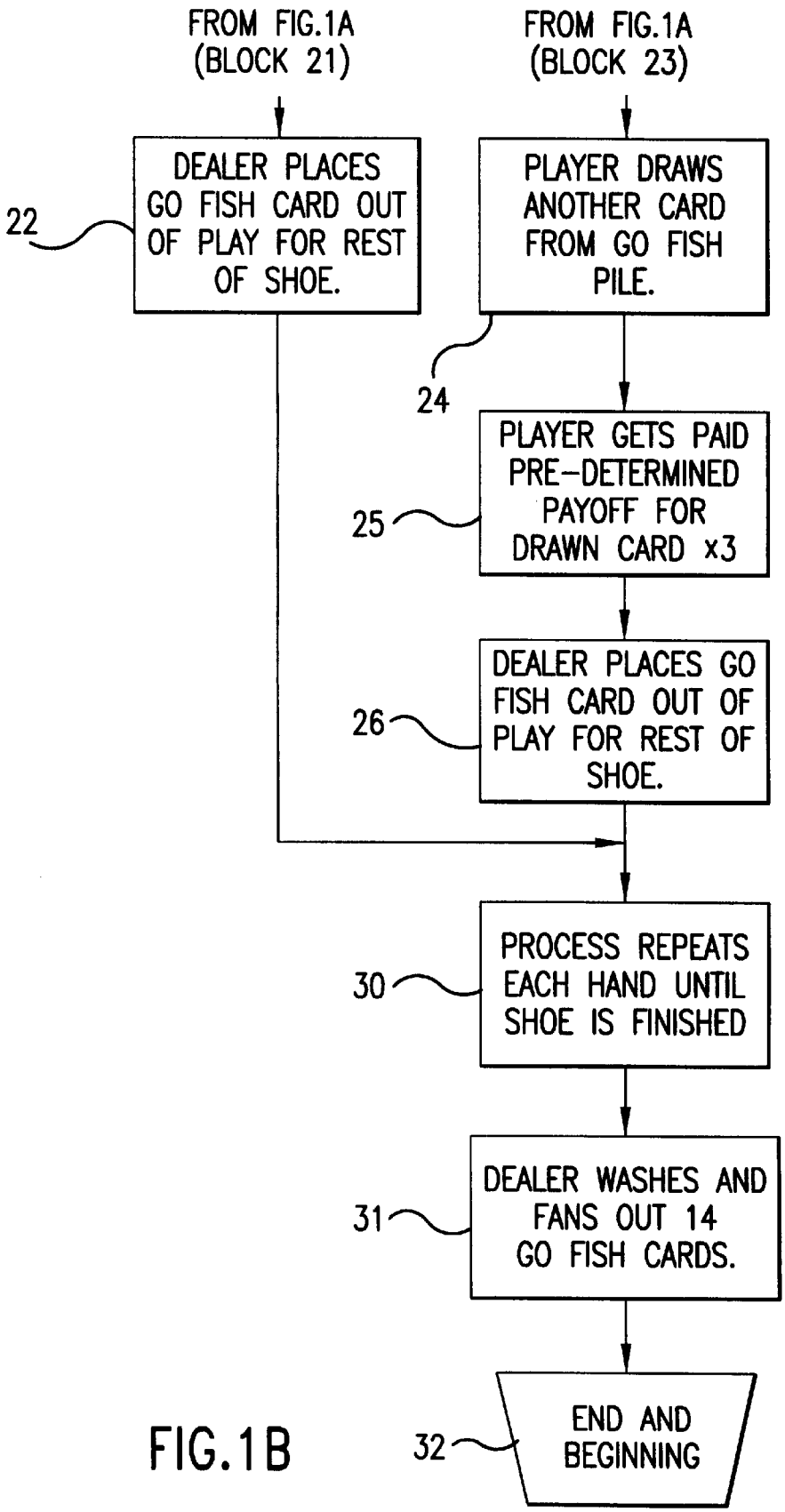

FIGS. 1A and 1B depict a flow diagram of play of a game in accordance with an embodiment of the present invention. As shown in FIG. 1A, play of the underlying Blackjack game begins (block 12) following preparation of a shoe containing five or six decks of standard playing cards and 14 Go Fish bonus cards (block 11). In accordance with standard Blackjack play, players initially place a Blackjack wager (block 12). Players are then provided with the option to place a Go Fish wager, so as to indicate a decision to participate in the Go Fish bonus portion of the game (block 14). For each player declining to participate in the Go Fish portion, play proceeds as normal Blackjack (block 15).

For players electing to participate in the Go Fish portion of play, those players failing to receive a Blackjack hand lose their Go Fish wagers (block 16). Those players receiving a Blackjack hand, push their Go Fish wager, and the Go Fish portion proceeds (block 17). Under the Go Fish portion of play, each player selects a Go Fish card, such as by placing a lammer adjacent to a number corresponding to a remaining Go Fish card (block 20). If a player draws any card other than a Joker, that player receives a predetermined payoff for the drawn card (block 21), and the dealer removes the selected Go Fish card, placing it out of play for the remainder of the shoe (block 22). Play then repeats, proceeding for each additional player and for the remainder of the shoe (block 30).

If the player receives the Joker as the selected Go Fish card (block 23), the player selects a second Go Fish card, such as by placing the lammer adjacent to a number corresponding to another of the remaining Go Fish cards (block 24). The player is then paid the predetermined payoff for the card with a multiplier applied, such as a triple bonus (block 25). The Joker and the additional Go Fish cards are then placed out of play for the remainder of the shoe (block 26). Play then repeats, proceeding for each additional player and for the remainder of the shoe (block 30).

Upon completion of the shoe, the dealer shuffles and fans out the Go Fish cards and prepares a new shoe for play (block 31). The entire sequence is then ready for repeat of play (block 32).

Figure 2:
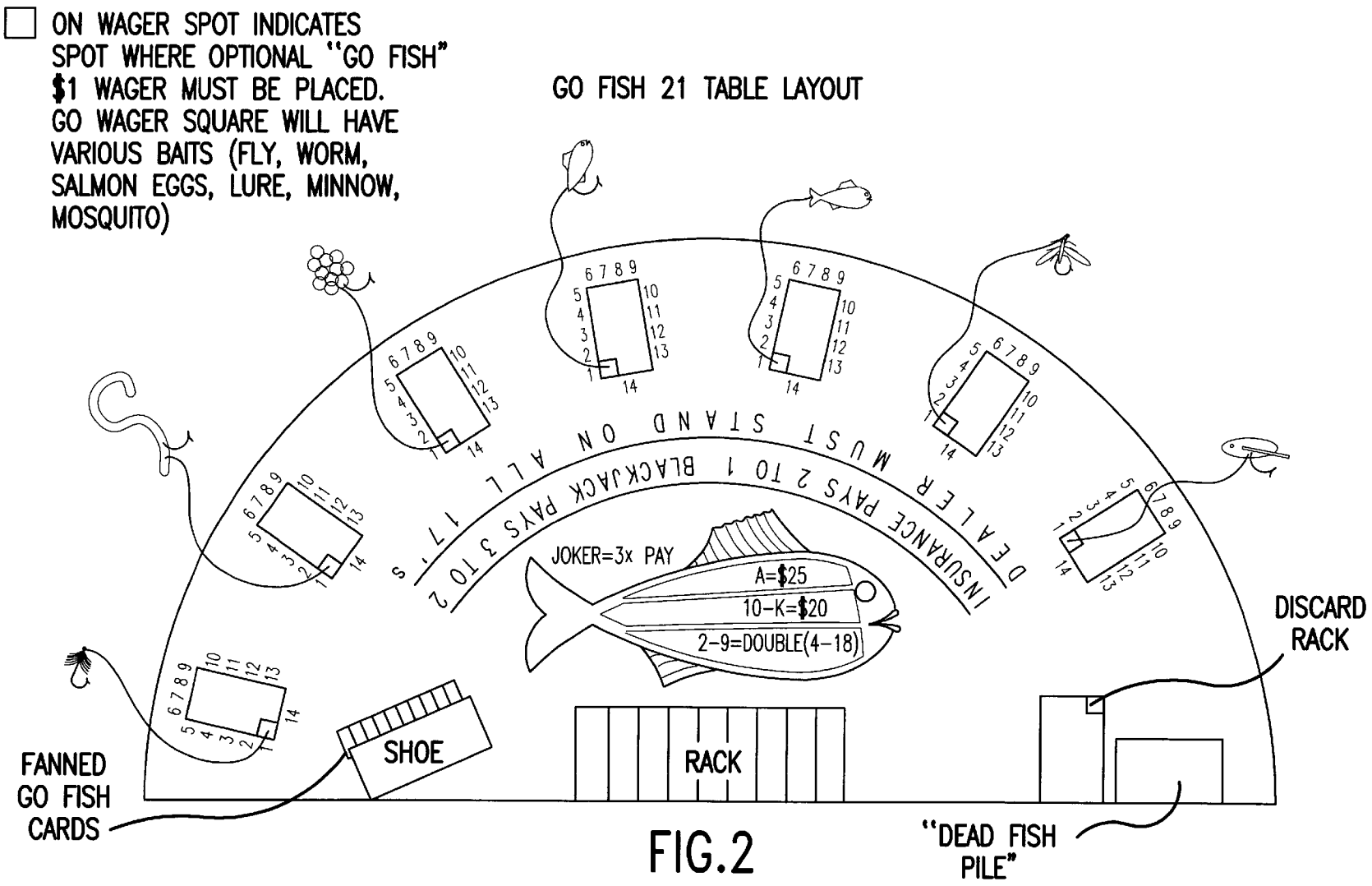
FIG. 2 presents a table layout in accordance with an embodiment of the present invention.

FIG. 2 presents a table layout in accordance with an embodiment of the present invention.

Figure 3:
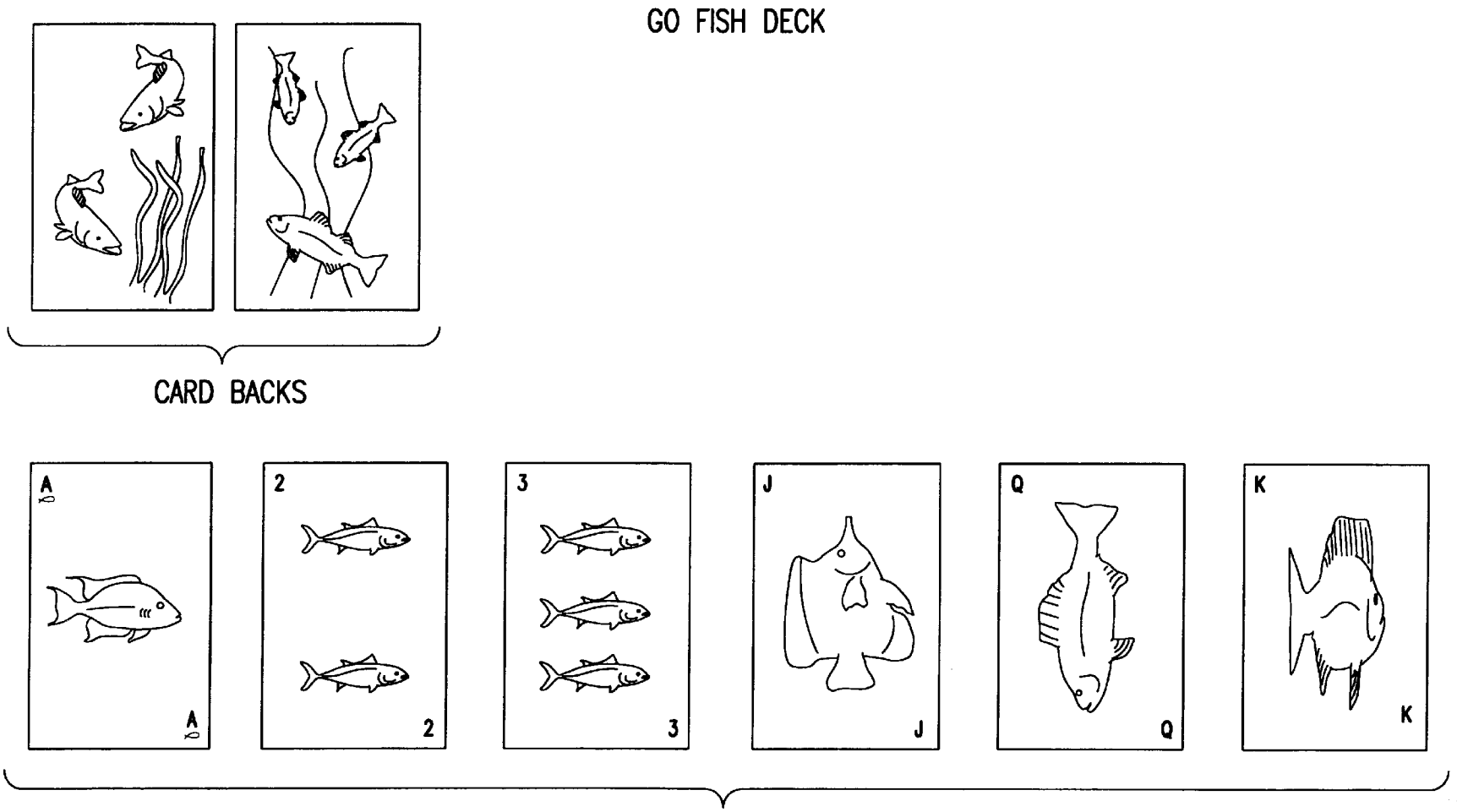
FIG. 3 shows example card backs for the "Go Fish" cards for use with an embodiment of the present invention.

FIG. 3 shows example card backs for the "Go Fish" cards for use with an embodiment of the present invention.

Thus, while there have been shown, described, and pointed out fundamental novel features of the invention as applied to embodiments thereof, it will be understood that various omissions, substitutions, and changes in the form and the details of the disclosed invention may be made by those skilled in the art without departing from the spirit of the invention.

What is claimed is:

1. A method for a plurality of players and a dealer to play a bonus game in conjunction with a card game, the card game being Blackjack, the card game being played with a plurality of playing cards and the bonus game being played with a plurality of selectable bonus game cards, the plurality of bonus game cards being maintained separately from the plurality of playing cards, wherein the plurality of selectable bonus game cards includes at least one Joker, the method comprising:

receiving from each of the plurality of players a selection as to whether to participate in the bonus game;

following receipt from each of the plurality of players of the selection as to whether to participate in the bonus game, providing each of the plurality of players with at least a first card and a second card from the plurality of playing cards, such that each of the plurality of players has a hand of cards;

identifying each of the plurality of players for which the hand of cards is a Blackjack hand;

for each of the plurality of players having a Blackjack hand and from whom the selection to participate in the bonus game is received:

receiving a selection of one from the plurality of bonus game cards;

revealing the selected one from the plurality of bonus game cards;

if the one from the plurality of bonus game cards is one of the at least one Joker, receiving a second selection of one from the plurality of bonus game cards; and providing a bonus to the player corresponding to the selected bonus game card or cards.

2. The method of claim 1, wherein the plurality of playing cards includes five decks of cards.

3. The method of claim 1, wherein the plurality of playing cards includes six decks of cards.

4. The method of claim 1, further comprising:

receiving an ante from each of the plurality of players prior to providing each of the plurality of players with at least a first card and a second card from the plurality of playing cards.

5. The method of claim 1, further comprising:

providing an option to each of the plurality of players to place at least one wager in the card game.

6. The method of claim 1, further comprising:

providing at least a first card and a second card from the plurality of playing cards to the dealer, such that the dealer has a hand of cards;

if the dealer hand of cards is a Blackjack hand, pushing the bonus game wager for each of the plurality of players having a Blackjack hand and from which the selection to participate in the bonus game is received.

7. The method of claim 1, further comprising:

providing an option to place a bonus game wager for each of the plurality of players selecting to participate in the bonus game;

receiving the bonus game wager from each of the plurality of players from whom a selection has been received to place the bonus game wager;

the dealer taking the bonus game wager for each of the plurality of players having a hand other than a Blackjack hand, and from which the selection to participate in the bonus game is received.

8. The method of claim 1, wherein receiving a selection of one from the plurality of bonus game cards comprises:

placing a lammer in a location corresponding to the one from the plurality of bonus game cards.

9. The method of claim 1, wherein providing a bonus corresponding to the selected bonus game card or cards comprises:

consulting a pay table to determine the bonus.

10. A gaming table for a plurality of players and a dealer to play a bonus game in conjunction with a card game, the card game being Blackjack, the card game being played with a plurality of playing cards and the bonus game being played with a plurality of selectable bonus game cards, wherein the plurality of bonus game cards includes a Joker, and wherein the plurality of bonus game cards is separately maintained from the plurality of playing cards, the gaming table comprising:

a table surface;

at least one player location indicated on the table surface, each of the at least one player location including a plurality of bonus card designation locations, each of the plurality of bonus card designation locations corresponding to one from the plurality of bonus game cards;

a dealer location indicated on the table surface;

a bonus card placement location indicated on the table surface;

wherein each of the plurality of players is provided with an option to play the bonus game;

wherein a selection is received from each of the plurality of players as to whether to participate in the bonus game;

wherein each of the plurality of players is provided with at least a first card and a second card from the plurality of playing cards, such that each of the plurality of players has a hand of cards;

wherein each of the plurality of players is identified for whom the hand of cards contains a Blackjack hand and from which a selection has been received to participate in the bonus game; wherein a selection is received from the player of one from the plurality of bonus game cards; wherein the one from the plurality of bonus game cards is revealed; wherein, if the revealed bonus game card is a Joker, a second selection by the player of one from the plurality of bonus game cards is received and the second selected card revealed; and wherein a bonus corresponding to the bonus game card or cards is provided to the player.

11. A device a player to play a bonus game in conjunction with a card game, the card game being Blackjack, the card game being played with representations of a plurality of playing cards and the bonus game being played with separately maintained representations of a plurality of bonus game cards, the plurality of bonus game cards including a Joker, the device comprising:

a display for displaying the card game, including the representations of revealed cards selected the plurality of playing cards; and a processor for receiving selections from the player for play of the game, for determining progress of play, and for processing and displaying a graphical user interface;

wherein the player is provided with an option to play the bonus game;

wherein a selection is received from the player as to whether to participate in the bonus game;

wherein the player is provided with representations of at least a first standard playing card and a second standard playing card, such that the player has a hand of cards;

wherein, for each player for whom the processor determines that the hand of cards contains a Blackjack hand and for whom a selection has been received from the player to participate in the bonus game, an option to select one from the plurality of bonus game cards is provided, and a selection is then received from the player; wherein the selected one from the plurality of bonus game cards is revealed; wherein, if the revealed bonus game card is a Joker, a second option to select one from the plurality of bonus game cards is provided, a second selection is received from the player, and the second selected card is revealed; and wherein a bonus corresponding to the selected bonus game card or cards is provided to the player.

12. The device of claim 11, wherein the device comprises a terminal, the terminal including the processor.

13. The device of claim 12, wherein the terminal is selected from a group consisting of a personal computer, a minicomputer, a microcomputer, and a mainframe computer.

14. The device of claim 12, wherein the terminal is coupled to the display.

15. The device of claim 12, wherein the terminal includes the display.

16. The device of claim 11, wherein the device comprises a computer screen, and wherein the computer screen includes the display.

17. The device of claim 11, wherein the device is a slot machine.

18. A method for at least one player to play an auxiliary game in conjunction with a Blackjack card game, the Blackjack card game being played with a plurality of playing cards, and the auxiliary game being played with a plurality of bonus game cards maintained separately from the playing cards, the plurality of auxiliary game cards including a Joker, the method comprising:

prior to dealing any cards, providing an option to each of the at least one player to participate in the auxiliary game;

receiving a selection from each of the at least one player as to whether to participate in the auxiliary game;

dealing a hand of cards to each of the at least one player;

identifying each of the at least one player having a hand of cards containing a Blackjack hand;

for each of the at least one player being dealt the Blackjack hand and from whom a selection to participate in the auxiliary game was received:

receiving a selection of an auxiliary game card;

if the selected auxiliary game card is the Joker, receiving a second auxiliary game card selection; and calculating a bonus based on the card or cards selected.

19. The method of claim 18, wherein dealing a hand of cards to each of the at least one player includes:

dealing a first pair of cards to each of the at least one player;

providing an option to each of the at least one player to select to receive additional cards; and for each of the at least one player selecting to receive additional cards, dealing additional cards to the player.

20. The method of claim 1, wherein providing each of the plurality of players with at least a first card and a second card from the plurality of playing cards includes:

dealing a first pair of cards to each of the plurality of players;

providing an option to each of the plurality of players to select to receive additional cards; and for each of the plurality of players selecting to receive additional cards, dealing additional cards to the player.

* * * * *